US007244198B2

(12) United States Patent
Morshed et al.

(10) Patent No.: US 7,244,198 B2
(45) Date of Patent: Jul. 17, 2007

(54) TENNIS BALL DELIVERY DEVICE

(76) Inventors: Hadi Morshed, 935 Napoli Dr., Pacific Palisades, CA (US) 90272; Nicholas A. Morshed, 935 Napoli Dr., Pacific Palisades, CA (US) 90272

( * ) Notice: Subject to any disclaimer, the term of this patent is extended or adjusted under 35 U.S.C. 154(b) by 0 days.

(21) Appl. No.: 11/363,894

(22) Filed: Feb. 28, 2006

(65) Prior Publication Data

US 2006/0196488 A1 Sep. 7, 2006

Related U.S. Application Data

(60) Provisional application No. 60/657,952, filed on Mar. 2, 2005.

(51) Int. Cl.
*A63B 69/38* (2006.01)

(52) U.S. Cl. ..... 473/459

(58) Field of Classification Search ..... 473/459, 473/473, 422, 474; 124/49, 50
See application file for complete search history.

(56) References Cited

U.S. PATENT DOCUMENTS 4,021,036 A * 5/1977 Nelson et al. ..... 473/459
4,538,810 A * 9/1985 Brophy ..... 124/7
4,548,407 A * 10/1985 Sato ..... 124/7
4,676,504 A * 6/1987 Ponza ..... 124/7
5,042,802 A * 8/1991 Depianta ..... 124/50
5,097,985 A * 3/1992 Jones ..... 221/86
5,292,119 A * 3/1994 Norcross ..... 473/451
5,520,397 A * 5/1996 Thompson ..... 473/459
6,176,230 B1 * 1/2001 Thompson ..... 124/16
7,001,289 B1 * 2/2006 Polega ..... 473/459
2006/0196488 A1 * 9/2006 Morshed et al. ..... 124/49

FOREIGN PATENT DOCUMENTS

DE 41 20 063 A1 * 12/1991

* cited by examiner

*Primary Examiner*—Raleigh W. Chiu
(74) *Attorney, Agent, or Firm*—Holland & Knight LLP; Richard E. Lyon, Jr.

(57) ABSTRACT

A tennis ball delivery device for use in practicing one's tennis stroke. The device includes an adjustable frame, at least one declining ball delivery conduit carried by the frame in an upper portion thereof, a declining ball discharge shoot carried by and communicating with the delivery conduit and a ball release mechanism carried by the discharge conduit. The release mechanism allows a single ball to fall from the shoot in response to the activation thereof. A depending handle that can be easily struck by the player's racket in initiating their tennis stroke is operatively connected to the release mechanism so as to effect the release of the ball.

13 Claims, 7 Drawing Sheets

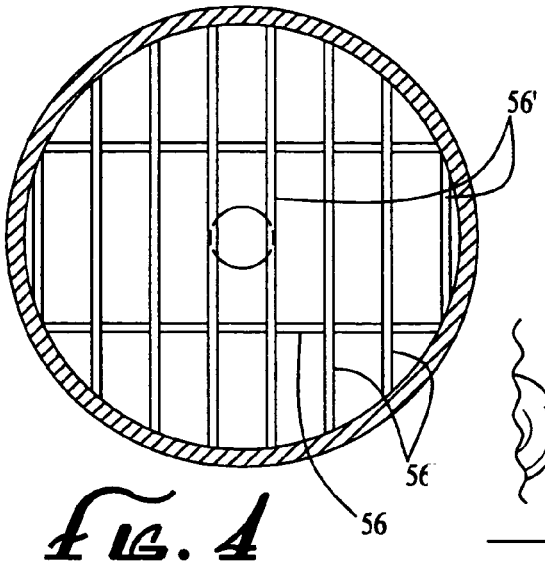
FIG. 4
FIG. 5
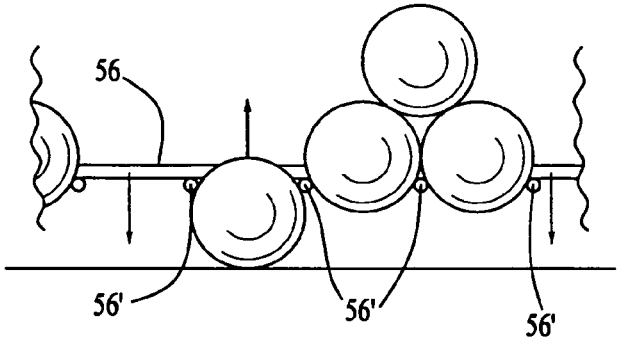
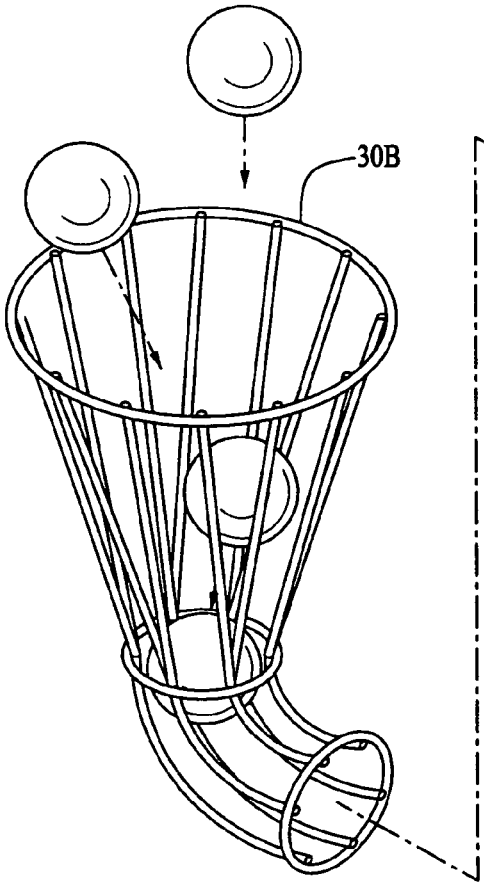
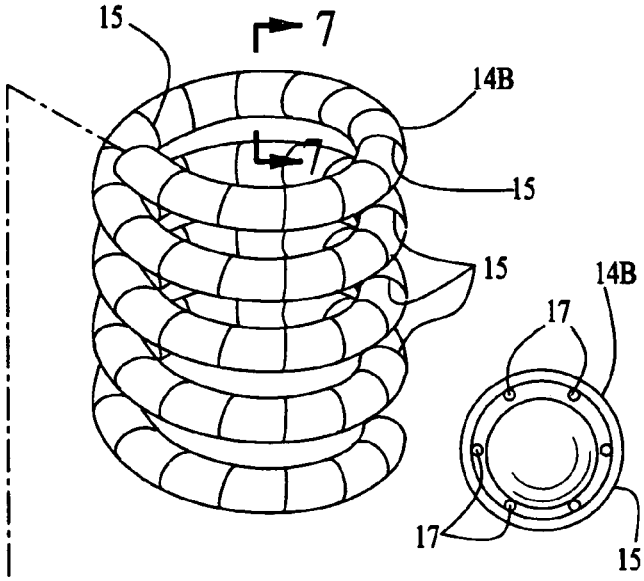
FIG. 7
FIG. 6

16A
44
48
18A
42A
40
18

16A
16'
14A
44
48
42A
18A
51
40
42B
38

14A
17
15
16'
17
15

16A
46
44
50
48
18A
18
42A
40
38

62
72
70
78
76
74

72
74
76
62
70
24
62
62
24
72
28
78
76
74
70
62

TENNIS BALL DELIVERY DEVICE

CROSS-REFERENCE TO RELATED APPLICATIONS

This application claims the benefit of U.S. Provisional Patent Application Ser. No. 60/657,952, filed Mar. 2, 2005.

BACKGROUND OF THE INVENTION

The present invention relates to a tennis ball delivery device and, more particularly, to a low cost, readily producible and easily portable device for holding a supply of tennis balls that, upon actuation by a player, will deliver a ball to the player for practicing his or her tennis stroke. While a wide variety of practice devices are presently available to tennis players for developing their strokes, they typically comprise devices that drive or shoot a ball over the net toward the player who then returns the ball using a backhand or forehand stroke. The proper tennis strokes and footwork are developed through repetitive practice. Such practice devices are relatively large and heavy and hence not easily portable which limits their use. They also require electricity and are relatively expensive, particularly for children in poor families and for people in general in less affluent countries who wish to learn the game of tennis. Because of the size and weight of such devices, they also are not easily used for practice by children and older players without assistance. Without a ball delivery device, a player or prospective player can only practice his or her strokes with a coach, which is very expensive, by hitting a ball against a wall, which generally does not provide repetitive practice of the same stroke, particularly for a novice, or by repetitively dropping a ball on the same spot and at the same height. By having to drop the ball and then turn and strike the ball, the player cannot focus on the proper body position prior to and during the stroke. Also, learning through repetition is impaired because the player has to continually leave his or her position to retrieve another ball. As a result, the rhythm of repetitive practice is lost.

It therefore would be desirable to provide a device that enabled one to practice his or her tennis stroke without the aid of another person, that obviated the need to repetitively retrieve balls, that was of simple construction so as to be economical to manufacture, and that was light in weight and easily portable. Such a device should also be capable of delivering the ball to the player at predetermined variable heights to accommodate differently sized players and to enable the players to practice different strokes. Such a device would not only be beneficial to all players but be affordable by a large group of potential tennis players who can not afford the ball delivery devices currently in use. Such a device also could be used by persons unable to physically transport and set up the tennis delivery ball devices currently available. The present invention provides such a device.

SUMMARY OF THE INVENTION

Briefly, the present invention comprises a tennis ball delivery device for use in practicing one's tennis stroke that obviates the need to retrieve a new ball after each stroke, is very economical to manufacture and is readily portable. The device carries a supply of tennis balls and, upon activation, drops a single ball from a selected and variable elevation so that the ball will bounce to a desired height where it can be struck by the player using either a forehand or a backhand stroke. In its preferred embodiment, the device comprises an adjustable and collapsible frame assembly, a pair of ball supply conduits carried in an upper portion of the assembly and a ball release mechanism carried by each of the lower outlet ends of the conduits, which project outwardly in opposed directions from the frame. The release mechanisms preferably employs a depending handle that can be easily struck by the player with his or her racket so as to effect the release of a single ball from the elevated conduit such that the ball can fall to the ground, bounce upwardly and be struck by the player. The release mechanism includes a stop for preventing more than one ball from falling from the conduit with each movement of the handle. By providing a pair of opposed ball outlets, a person can practice his or her forehand and backhand stroke without having to move the ball delivery device. The frame assembly preferably is formed in detachable sections that allows for varying the elevation of the ball conduit and nesting of the frame sections for portability and storage. One portion of the frame assembly is preferably provided with a wire grid surface that functions as a support surface during use as a ball delivery device, as a bottom flooring for the device in the nested carrying position, and as a ball retrieval device.

It is therefore the principal object of the present invention to provide a ball delivery device for practicing one's tennis stroke which is highly versatile, of simple construction so as to be economical to manufacture and is readily portable.

These and other objects and advantages of the present invention will become readily apparent from the following detailed description taken in conjunction with the accompanying drawings.

BRIEF DESCRIPTION OF THE DRAWINGS

FIG. 4 is a sectional view taken along the line 4—4 of FIG. 3.

FIG. 5 is a schematic illustration of the lower wire grid surface of the lower portion of the frame assembly functioning as a ball retrieval device.

FIG. 6 is an exploded perspective view showing one of the ball delivery conduits employed in the present invention as viewed from the opposite side as FIG. 1 and an enlarged ball collection funnel formed of welded wire that is adapted to be secured to the upper upstream end of the delivery conduit.

FIG. 7 is a sectional view taken along the line 7—7 of FIG. 6.

FIG. 16 is a perspective view of a second alternate embodiment of the present invention.

DETAILED DESCRIPTION OF THE PREFERRED EMBODIMENT

Figure 1:
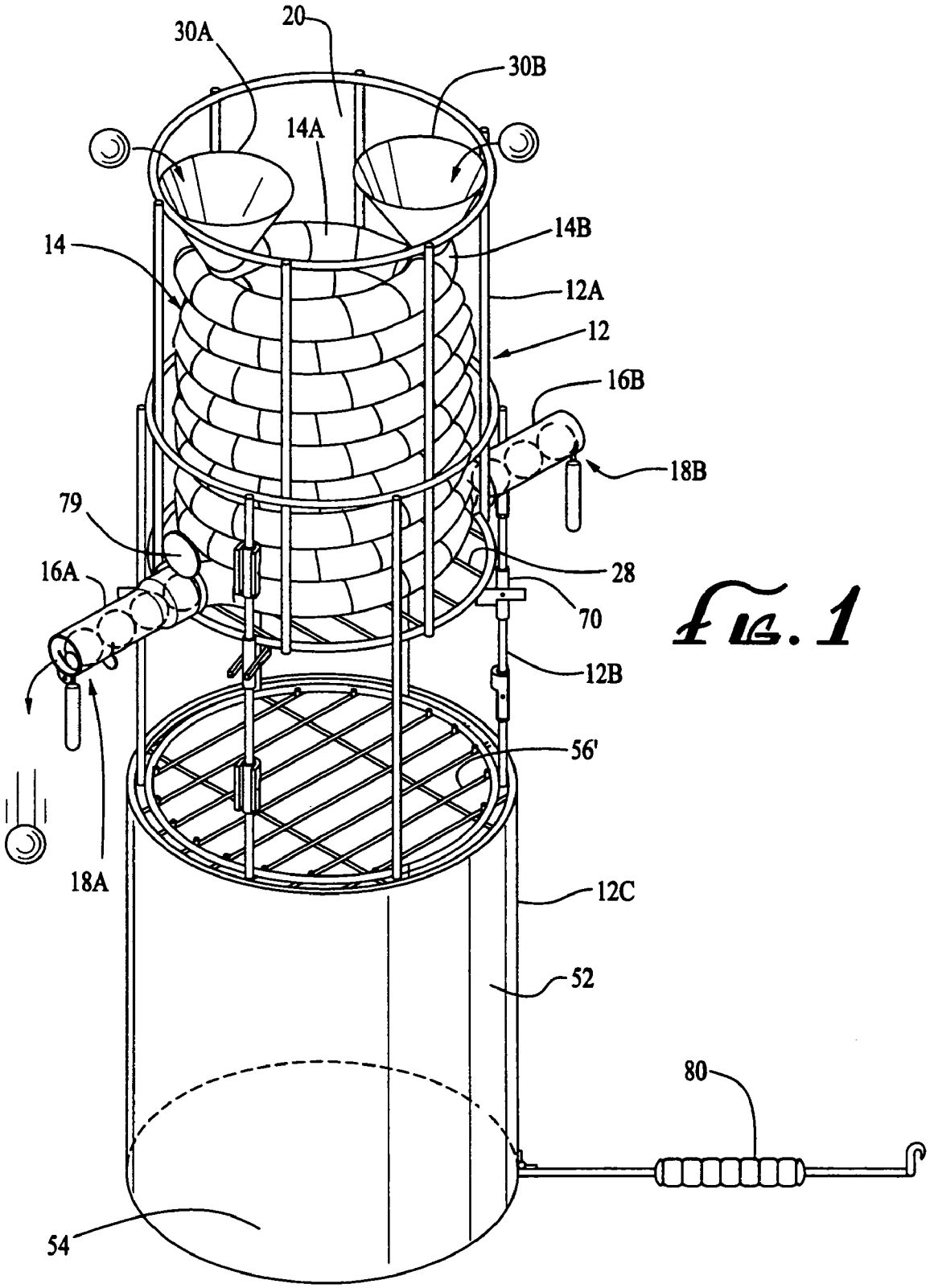
FIG. 1 is a perspective view of the ball delivery device of the present invention.

The tennis ball delivery device 10 of the present invention includes a frame 12 that is preferably adjustable and collapsible, one or more ball delivery conduits 14 carried within an upper portion of the frame, a ball delivery chute 16 affixed to the lower end of each of the conduits and a ball release mechanism 18 carried by the downstream end of each of the ball delivery chutes. In a preferred embodiment of the invention illustrated in FIGS. 1-14, the frame 12 comprises an upper frame section 12A, an intermediary frame section 12B and a lower frame section 12C. The ball delivery conduit 14 is carried within the upper frame section 12A and comprises a pair of separate conduits 14A and 14B nested together in a helical array. A pair of corresponding ball delivery chutes 16A and 16B are affixed to the lower ends of ball conduits 14A and 14B and a pair of ball release mechanisms 18A and 18B are carried by the downstream ends of the ball delivery chutes.

The upper frame section 12A is preferably formed of a welded wire construction so as to render the frame section relatively rigid, substantially transparent and light in weight. It is to be understood that other durable and lightweight frame constructions could be employed and that the particular wire structure illustrated in the drawings is merely a representative example of one of a variety of welded wire configurations that could be employed to form the upper section 12A of the delivery device 10.

Figures 2, 3:
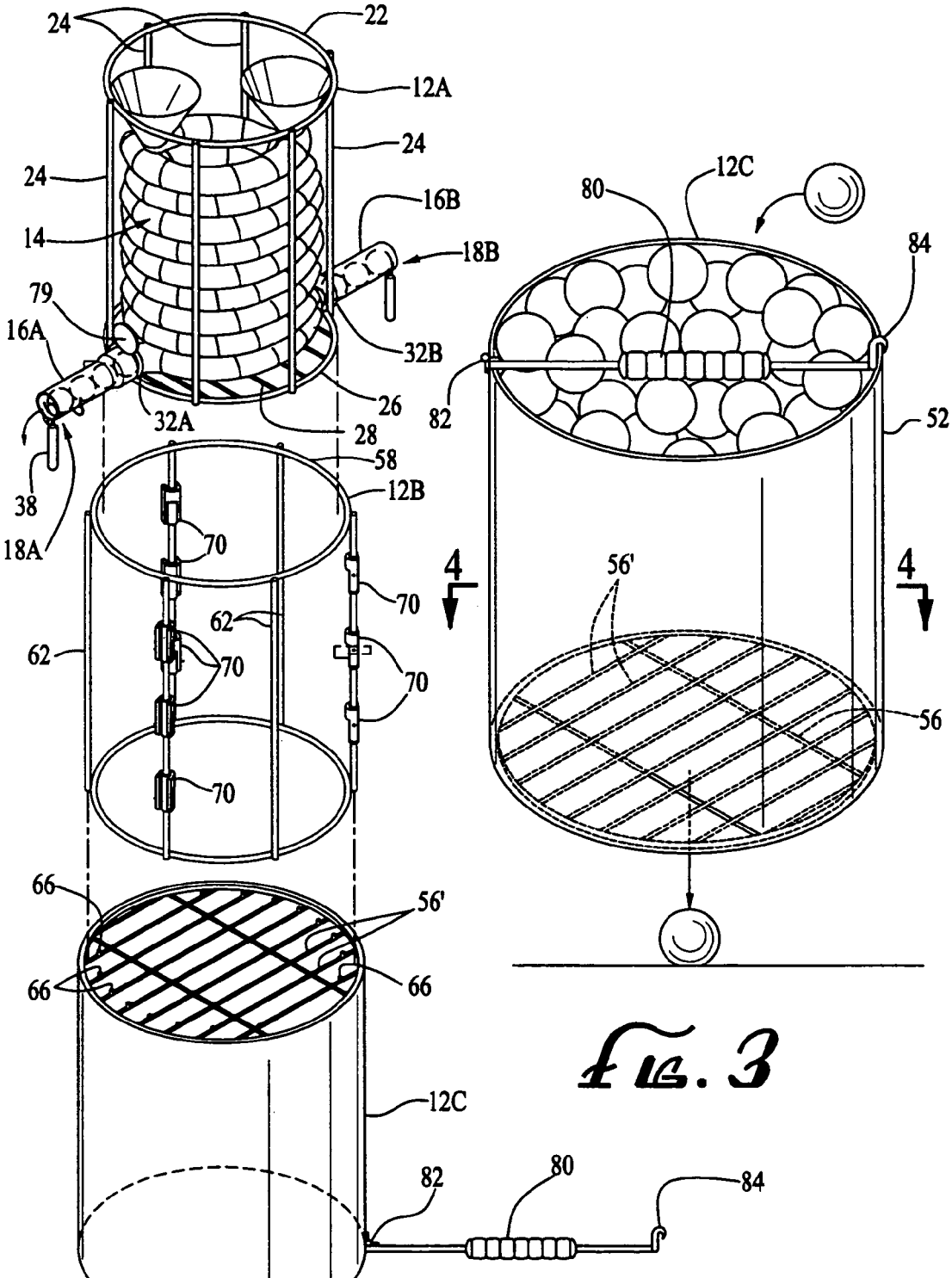
FIG. 2 is a perspective exploded view of the ball delivery device of the present invention.
FIG. 3 is a perspective view of the lower portion of the frame assembly illustrating its use as both a ball carrying device and a ball retrieval device.

As seen in FIGS. 1 and 2, the frame upper section 12A defines an open upper end 20 circumscribed by a horizontally disposed circular upper wire 22 and bordered by a plurality of vertical frame wires 24. The lower end of the upper frame section 12A is provided with a horizontally disposed lower wire ring 26 to which the lower ends of the vertical wires 24 are welded or otherwise suitably secured. A wire grid 28 is provided interiorly of the lower ring 26 to define a flooring for the upper frame section that supports the ball delivery conduits 14A and 14B disposed therein as seen in FIGS. 1 and 2. The upper frame section 12A also may include one or more intermediary horizontal ring wires (not shown). Again, other suitable frame configurations could be employed.

The ball delivery conduits 14A and 14B are preferably provided with ball collection funnels 30A and 30B at their upper inlet ends and extend downwardly therefrom in opposed nested helical paths about the interior of the upper frame section 12A to their respective outlet ends 32A and 32B. As with the upper frame section 12A, the ball delivery conduits 14A and 14B (which are schematically illustrated in the drawings) are preferably formed of a wire configuration so as to be light in weight and to allow the user to be able to see and reach through the sidewalls of the conduits to identify any ball jams therein and relieve those jams by simply inserting a finger through the conduit wall and loosening the jammed balls. The delivery conduits and collection funnels, while preferably formed of wire, appear solid in the drawings as they are schematically illustrated so as not to overly clutter the interior of the upper frame section 12A in the drawings as would occur if the ball delivery conduits were illustrated in more detail in their preferred wire construction. A ball collection funnel 30B formed of welded wire is illustrated, however, in FIG. 6.

It is important that the ball delivery conduits 14A and 14B be formed so that a tennis ball can roll downwardly therethrough without obstruction. FIG. 7 illustrates a cross section of a representative example of such a conduit construction. As seen therein, the conduit 14B is formed of a plurality of annular wires 15 and longitudinal wires 17 that are disposed interiorly of the annular wires so that the balls can roll along the longitudinal wire 17 unimpeded by the annular wires 15. As with the construction of the frame section, other wire and non-wire conduit configurations could be employed. For example, the annular wire portion of the two helical conduits could be formed of a single or plurality of helically extending wires (similar to a coil spring) as opposed to a plurality of individual axially spaced annular wires. Alternatively, the conduits could be formed of a solid material such as plastic. Such a solid construction, however, may employ a transparent or translucent material so that interior ball jams can be readily identified and apertures should be provided in the sidewalls of such conduits so that the user can readily clear any such ball jams.

The opposed ball delivery chutes 16A and 16B attached to the lower downstream ends of conduits 14A and 14B (see FIG. 8) extend exteriorly from the frame in a downward inclination and are preferably constructed of a transparent or translucent durable plastic material and provided with flared upstream end portions 16' so as to fit about the downstream ends of the ball delivery conduits in a press fitment. Such an attachment allows the chutes to be readily removed for transporting and storage.

Figures 8, 9, 10, 11, 12, 13:
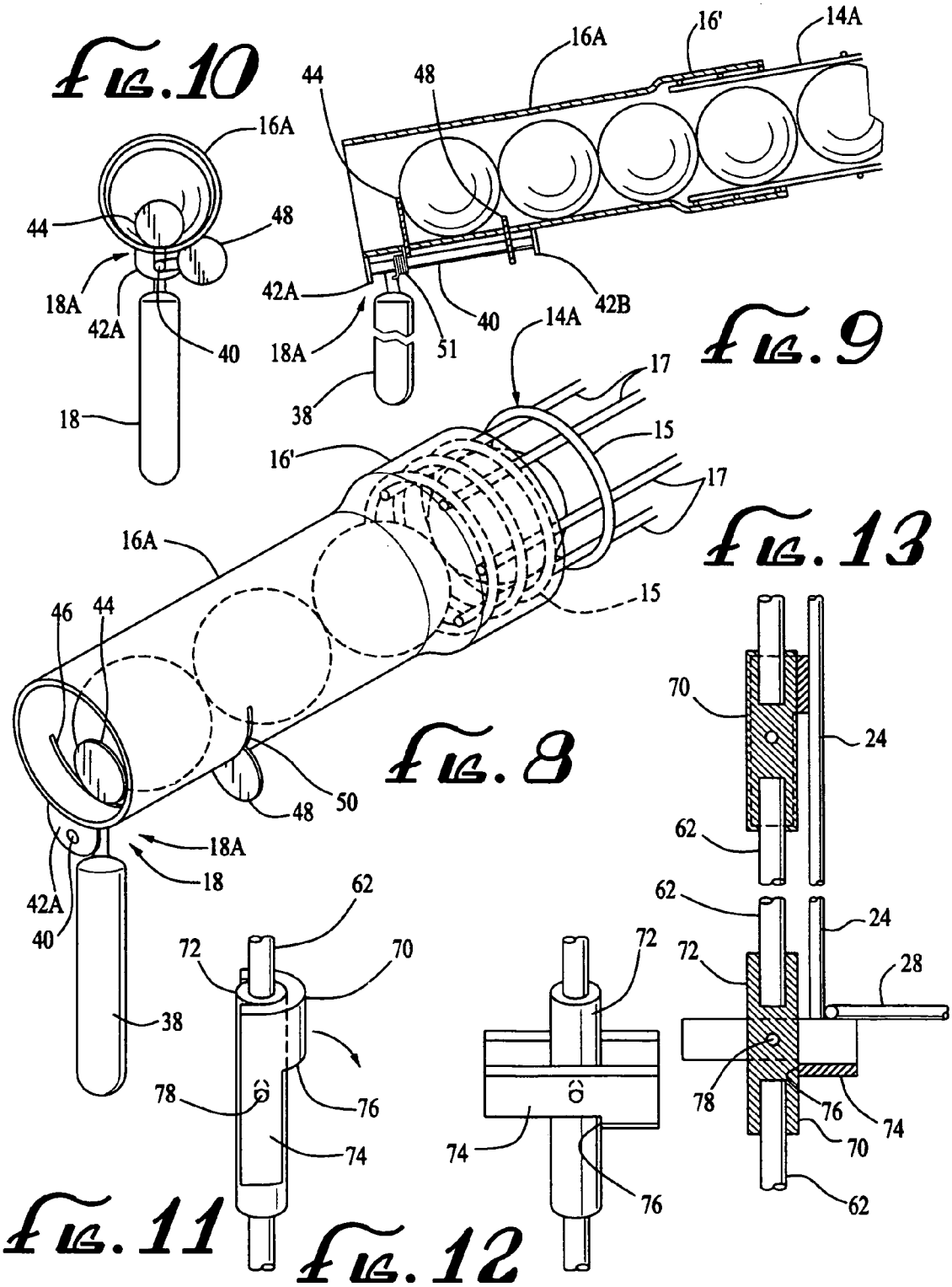
FIG. 8 is a perspective view of a ball delivery chute and attached ball release mechanism mounted on the downstream end portion of a ball delivery conduit.
FIG. 9 is a side view of a ball delivery chute secured to the downstream end of a ball delivery conduit with the sidewalls broken away to illustrate the interior of the chute and conduit.
FIG. 10 is an end view of a ball delivery chute and attached ball release mechanism.
FIG. 11 is a partial perspective view of a portion of the intermediary frame section of the present invention showing an attached upper frame support bracket in the folded position.
FIG. 12 is a partial perspective view of a portion of the intermediary frame section of the present invention showing an attached upper frame support bracket in the extended support position.
FIG. 13 is a partial sectional view of portions of the intermediary frame section of the present invention showing an upper frame support bracket in the folded position and an intermediary support bracket in the extended support position with a position of the upper frame section resting thereon.

Ball release mechanisms 18A and 18B are provided on the delivery chutes. The preferred release mechanism is manually activated to reduce costs and, as seen in FIGS. 8-10, comprises a depending elongated handle 38 that is rigidly affixed to a rod 40. Rod 40 is axially aligned with and rotatably mounted on the underside of the chutes by brackets 42A and 42B. A first downstream stop member 44 is affixed to and extends from rod 40 in opposed substantial axial alignment with handle 38 and projects into the interior of the adjacent chute through a slot 46 formed in the underside of the chute. Stop member 44 can be of any desired configuration as its function is simply to block the lower end of the discharge chute when the handle 38 is hanging in a vertical disposition. A generally circular disc or paddle-shaped configuration is illustrated in the drawings (see, e.g., FIG. 8). A second stop member 48 is also provided on each of the rods 40 and projects radially therefrom at a 90° angle with respect to the first stop member 44. A second slot 50 is provided in the lower and side portions of the discharge chutes upstream of slot 46 so that the second stop member 40 can project therethrough into the chute. The spacing between slots 46 and 50 and thus between stop members 44 and 48 is about 2.5 inches which is substantially equal to the diameter of a tennis ball (a new ball is typically within the range of about 65-66 mm.).

As a result of the aforesaid configuration, the elongated handles 38 on the ball release mechanisms will hang under the force of gravity in vertical dispositions from the rotatably mounted rods 40 as shown in FIG. 8. In this position, the first stop members 44 project upwardly from rods 40 into their respective discharge chutes, blocking the outlet ends of the chutes and thus preventing any tennis balls disposed within the chutes from falling from the chutes. In this orientation, the second stop members 48 projects outwardly from rods 40 in directions normal to the first stop members 44, exteriorly of the discharge chutes as seen in FIGS. 8 and 10. Rotation of one of the release handles 38 causes corresponding rotation of rod 40 and of the two stop members affixed thereto. The first stop member 44 rotates out of the path of any balls within the discharge chute, while concurrently bringing the second stop member 48 into the path of the balls in the chute directly behind the lead ball. Accordingly, if the chute were filled with tennis balls as seen in FIG. 8, and the user were to strike the release handle 38 with his or her tennis racket so as to rotate the handle, the bar 40 will also rotate, causing the first stop member 44 affixed thereto to move out of the path of the lower most ball, whereupon the ball will fall from the discharge chute as illustrated in FIG. 1. Concurrently, the second stop member 48 is rotated into the path of the next ball in line, preventing that ball and any balls behind it from advancing within the discharge chute. When the handle returns to its depending vertical position, the first stop member returns to its ball blocking or stop position illustrated in FIGS. 8-10 and the second stop rotates back out of the path of the then lowermost ball in the chute, allowing that ball to advance to a position adjacent the first stop member. Any balls behind it in the chute will also advance. To facilitate the return rotation of handle 38 after the lead ball falls from the discharge chute, a spring member 51 can be operatively connected between the rotating rod 40 and the chute. Spring member 51 could be a coil spring, torsion spring or any other suitable biasing means that would return the first stop member 44 to the ball blocking position. Thus, each time a person hits the release handle 38 with his or her racket so as to cause the handle to pivot from about 45°-90°, depending on the configuration of the first stop member 44, one ball will fall from the chute to be hit by the player and each ball in the ball delivery conduit communicating with that chute will advance one spot, i.e., a distance equal to the diameter of one ball.

In use, a person will hit the ball using either a backhand or forehand stroke after the ball falls from the discharge chutes 16A or 16B and bounces to a predetermined height. By providing two opposed discharge chutes, one can hit both forehand and backhand shots without having to rotate the frame 180°. The height to which the ball will bounce depends on the elevation of the discharge chute above the ground. Accordingly, to accommodate players of varying height and to enable a player to practice hitting the ball at various elevations, the frame 12 should be adjustable in elevation. This is accomplished in the embodiment of the invention illustrated in FIGS. 1-14 by means of the intermediary frame section 12B.

As seen in FIGS. 1 and 2, the upper frame section 12A, which carries the ball delivery conduits 14A and 14B and thus discharge chutes 16A and 16B, is mounted on or partially within the intermediary frame section 12B which in turn sits atop of the lower frame section 12C. For reasons to be explained, the lower frame section 12C is preferably constructed of an inexpensive lightweight plastic material so as to define a solid cylindrical wall 52 for the lower frame section. The lower end 54 of the lower frame section is open and a wire mesh grid 56 extends thereacross. For reasons to be explained, the spacing between the laterally extending wires 56' in grid 56 are spaced apart about 2.25 inches, a distance slightly less than the diameter of a worn tennis ball. During normal use, the grid 56 simply forms the upper surface of the lower frame section and provides a support for the intermediary frame surface 12B.

Intermediary frame section 12B, like the upper frame section 12A, is preferably of a welded wire construction and comprises an upper, circular, horizontal ring wire 58, a lower, circular, horizontal ring wire 60 and a plurality of vertically extending support wires 62 which are welded or otherwise secured to the upper and lower ring wires 58 and 60. Depending on the gage of the wire employed in the formation of the intermediary frame section 12B and the rigidity of the section desired, one or more ring wires (not shown) could also be secured to the vertical support wires 62 intermediary of the upper and lower wires 58 and 60. As seen in FIG. 1, the frame sections 12A, 12B, and 12C define diameters such that the lower ring wire 62 of the intermediary frame section 12B and the attached vertical support wires 62 fit on the support grid 56 of the lower frame section 12C inwardly adjacent an upper perimeter wall 64 defined by the upper end of the cylindrical sidewall 52 of the lower frame section 12C. A plurality of upstanding tabs 66 are preferably welded or otherwise affixed to the grid 56 in a circular array so as to bear against the lower horizontal ring wire 60 of the intermediary frame section 12B, securing the lower end of the intermediary frame section 12B on the lower frame section 12C as illustrated in FIG. 1.

The upper frame section 12A in turn fits at least partially within the intermediary frame section 12B as is also illustrated in FIG. 1 and is supported therein at a desired height by a plurality of support brackets 70. In the drawings, three support brackets 70 are shown as being provided on three equiangularly-spaced vertical support wires 62 of the intermediary frame section to provide a balanced support surface for the upper frame section. If desired, a greater or perhaps a lesser number of the vertical support wires could be provided with the support brackets 70, depending on the frame design. By providing three vertically spaced brackets 70 on the individual vertical support wires 62, the elevation of the support surface provided by the brackets can be varied. Similarly, a greater or lesser member of support brackets could be employed on the vertical support wires depending on the frame design and the desired member of height adjustments.

The individual support brackets 70 are illustrated in FIGS. 11-13. As seen therein, each bracket includes a cylindrical body portion 72 that is rigidly affixed to a vertical wire 62 and a "U"-shaped support member 74 which is bifurcated over approximately two-thirds of its length to define a stop 76 and is pivotally mounted on the body position 72 by a pin 78. When the support brackets 70 are in the collapsed or folded position, illustrated in FIG. 11, the "U"-shaped support portion 74 of the bracket is substantially flush with the cylindrical body portion 72 so as not to interfere with the sliding movement of the upper frame section through the intermediary frame section during assembly. When the "U"-shaped support portion 74 is pivoted about the mounting pin 78, as seen in FIG. 12, the stop 76 defined by the termination of the bifurcated portion of the bracket abuts the cylindrical body portion 72 so as to hold the "U"-shaped support portion 74 in a horizontal disposition. So disposed, the right side of the support portion 74 of the bracket 70 (as seen in FIG. 12) will support a vertical force such as the weight of the upper frame section 12A, ball delivery conduits 14A and 14B and the associated chutes 16A and 16B and ball release mechanisms 18A and 18B. It is to be understood, that other bracket configurations and indeed other means of adjusting the elevation of the ball discharge chutes 16A and 16B could be employed in the present invention. For example, the vertical support legs 62 of frame section 12B could be of a telescoping configuration.

FIG. 13 illustrates the intermediary of the three vertically spaced support brackets 70 on one of the vertical support wires 62 on the intermediary frame section in the extended position, supporting the upper frame section 12C, and the upper bracket 70 on the same vertical support wire 62 in the folded position so as not to interfere with the insertion of the upper frame portion onto the intermediary support bracket 70. In such a disposition, all of the intermediary support brackets 70 would be disposed in the support position to effectively define a planar support for the upper frame section. In this position, an intermediate elevation of the ball delivery chutes 16A and 16B is provided. If the player wished to practice his hitting the ball at a higher elevation, the upper frame portion 12A would be mounted on the uppermost support brackets 70. Conversely, mounting the upper frame section 12A on the lower support brackets would provide a lower bounce and positioning the lower end of the upper frame portion directly on the support grid 56 would provide an even lower ball bounce for the player.

Figure 14:
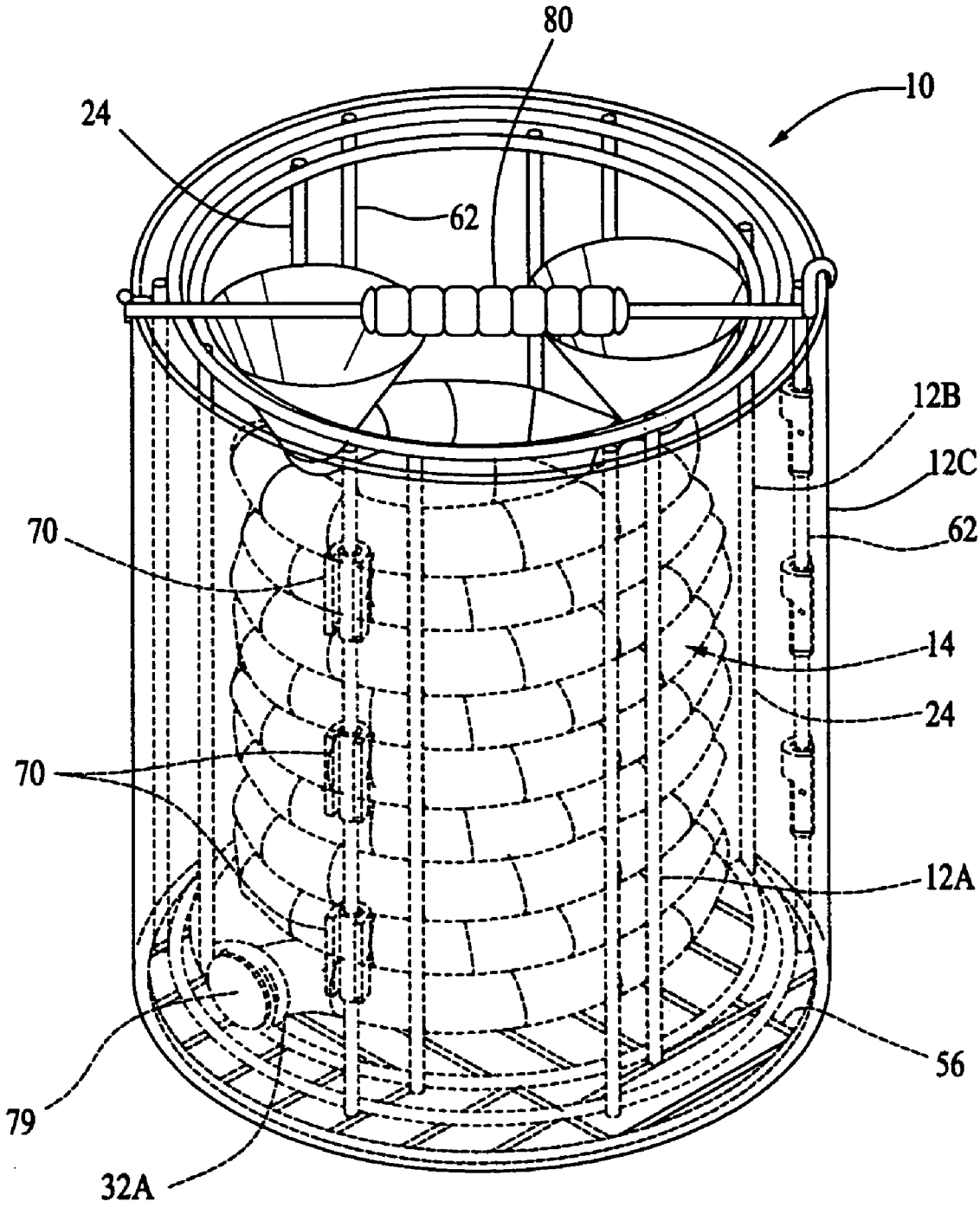
FIG. 14 is a perspective view of the ball delivery device of the present invention in the nested transportation and storage mode.

In addition to providing a variety of elevations at which the discharge chutes can be readily and securely positioned, the aforesaid frame configuration allows the individual frame sections to be nested together for carrying and storage as illustrated in FIG. 14 and for the lower frame section 12C to be individually used to collect tennis balls as illustrated in FIGS. 3-5. As previously described, the lateral wires 56' defining grid 56 on the lower frame section are spaced apart about 2.25 inches, i.e., slightly less than the approximate diameter of a worn tennis ball. Thus, by removing the upper and intermediary frame sections from the lower frame section 12C and inverting the lower frame section, the grid 56 now becomes a bottom surface for the section as illustrated in FIG. 13. Pressing the bottom grid surface of the frame section over a tennis ball will cause temporary deformation of the ball so that the ball can pass between the wires 56' of grid 56 and into the interior of the lower frame section as seen in FIG. 5. The balls quickly return to their unstressed state and will thus be held within the inverted lower frame section. A pivotally mounted handle 80 preferably is provided on the lower frame section at the opposite end thereof from grid 56 so as to effectively convert the lower frame section 12C into a ball collection bucket as illustrated in FIG. 3.

As noted previously, the individual frame sections when detached can be nested together for transportation and storage, such a configuration is illustrated in FIG. 14. As seen therein, the helically nested delivery conduits 14A and 14B remain positioned within the upper frame section 14A with the ball delivery chutes 16A and 16B removed. Those chutes are simply positioned interiorly of the coiled delivery conduits 14A and 14B and are supported by the grid 28 at the lower end of the upper frame section. With all of the support brackets 70 in the folded position, the upper frame section will slidably fit within the intermediary frame section. A pivotally mounted closure 79 is preferably provided adjacent the outlet ends 32A and 32B of the ball delivery conduits to enable the conduits to carry a supply of tennis balls when the device 10 is in the transportation and storage mode illustrated in FIG. 14. In its inverted position, the lower frame section 12C can accommodate the nested upper and intermediary frame sections and the elements carried thereby within the cylindrical wall 52 of the lower frame section. In this regard, it should be noted that the cylindrical wall 52 could be made of a variety of lightweight inexpensive materials including plastic metal sheeting and welded wire.

As is also illustrated in FIG. 14, handle 80 which is employed when using the lower frame section by itself as a ball retrieval device is also utilized for carrying the entire ball delivery device in the nested transportation and storage mode. Handle 80 preferably is pivotally mounted at one end 82 to the lower frame section 12C so that it can be positioned to the side of the device 10 during use as seen in FIG. 1. The other end of handle 80 is preferably defines an attachment hook 84 or other suitable connector that is adapted to extend through a slot or engage a projection provided on the opposite open end of the lower frame section such that the handle 80 can also function as a carrying handle as above described.

Figure 15:
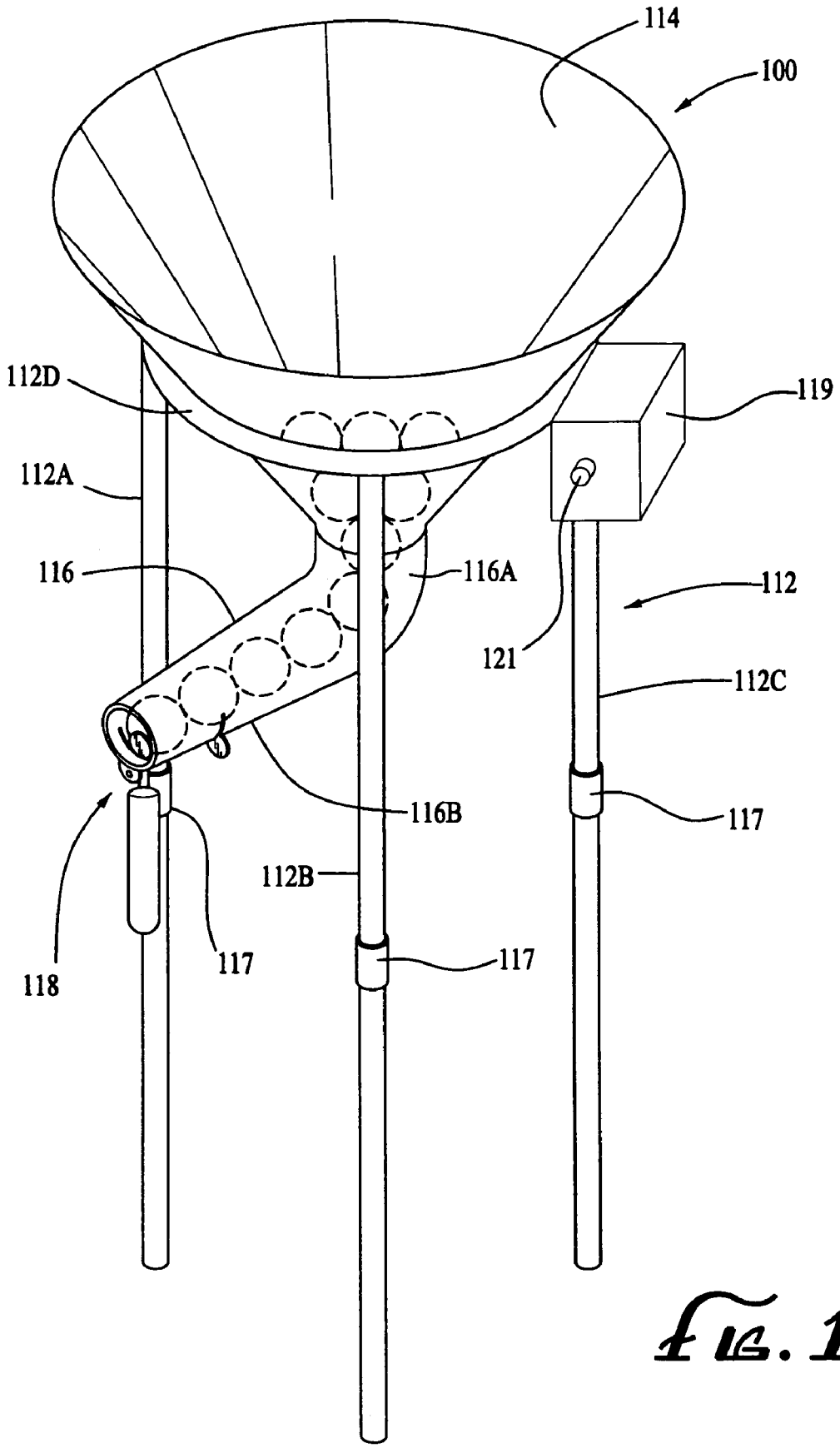
FIG. 15 is a perspective view of an alternate embodiment of the present invention.
Figure 10:
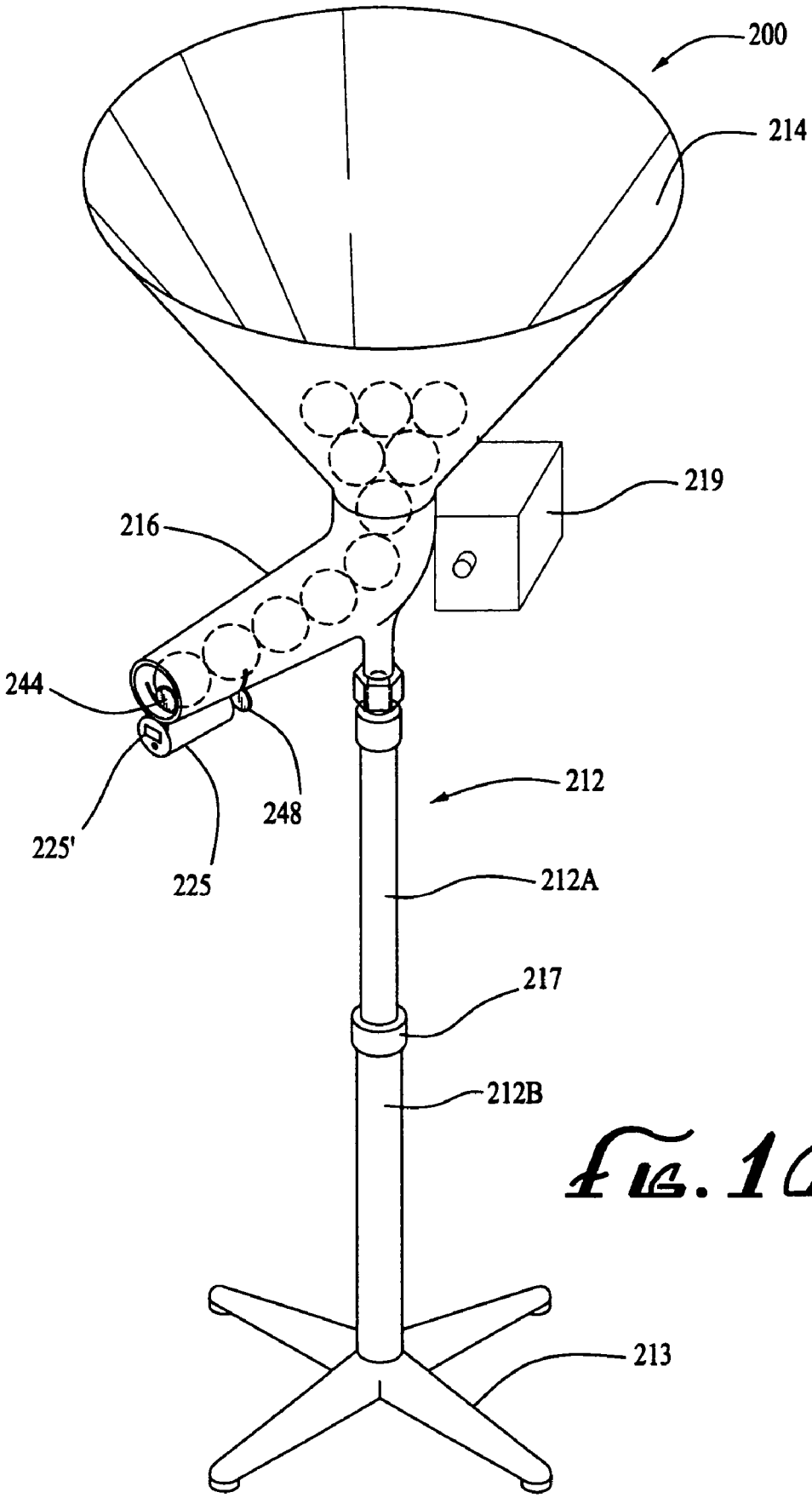

A second embodiment of the present invention is illustrated in FIG. 15. In the tennis ball delivery device 100 illustrated therein, the frame 112 comprises a plurality of telescoping legs (three being shown) 112A, 112B, and 112C joined at their upper ends in a circular support ring 112D. The upper ends of the legs can be permanently secured to the upper support ring by welding or an adhesive suitable for the materials of which the frame is constructed or removeably secured by a threaded engagement or other suitable fastening means. The frame could be constructed of a durable plastic or a metal material. The ability of the legs to telescope allows for variation in the elevation of the ball delivery chute 116. The telescoping function can be provided by conventional threaded clamps 117 that compress a slotted end of an outer leg section about a portion of an inner leg section as illustrated in the drawing. Other telescoping leg configurations could, of course, be employed. For example, a plurality of a longitudinally spaced apertures could be provided on the lower leg portions and a spring biased pin provided on each of the upper leg portions which slide within the lower leg portions and are secured thereto at the desired elevation by the pins projecting through the selected apertures. Other telescoping means could also be employed.

The ball collecting conduit in the delivery device 100 comprises a large funnel 114 which fits within and is supported by the support ring 112D on the frame. The ball delivery chute 116 is preferably removable from the bottom of the funnel 114 for storage and travel and comprises an upper vertical portion 116A and lower inclined portion 116B so as to define a continuous downward path for the sequential delivery of tennis balls from the funnel through the chute. A ball release mechanism 118 similar to that employed in the prior embodiment is carried by the delivery chute as illustrated in the drawing. To prevent the lower outlet end of the funnel from being clogged with balls, a conventional vibrator 119 can be attached thereto so that in the event the funnel fails to properly feed balls, the vibrator could be activated by a push button 121 or a remote control activation device to effect the vibration of the funnel and an unclogging of the ball jam at the bottom of the funnel.

In use, the ball delivery device of FIG. 15 is operated in the same manner as the device 10 of the prior embodiment. However, if only a single outlet chute is employed as shown, it will be necessary to reverse the orientation of the device 100 to practice both backhand and forehand strokes.

A third embodiment of the invention is illustrated in FIG. 16. The ball delivery device 200 of FIG. 16 differs from that of FIG. 15 primarily in the design of the frame 212 and the means for activating the ball drop mechanism. As indicated earlier, a wide variety of frame constructions could be employed in the present invention. Frame 212 comprises a single leg comprised of an upper portion 212A and lower portion 212B and a bottom pedestal stand support 213. As with the prior embodiment, a variety of means could be employed to effect the telescoping of the frame 212. A conventional threaded attachment 217 is illustrated in FIG. 16. The remainder of the components of the delivery device 200 are basically identical to those in the above-described device 100 except that the ball delivery device 200 is provided with an automatic delivery chute activator 225. The activator 225 eliminates the need for a player to physically strike the ball release handle as in the prior embodiments. Activator 225 can be a conventional timer such as those employed in ball pitching machines and could allow the user to set the frequency of the ball drop, i.e., interval of the rotation of the rod carrying the first and second stop members 244 and 248 respectively. Such a timer would allow the user to rhythmically practice his or her strokes by providing a constant time duration between the dropping of each ball. Alternatively, the activation device 225 could comprise a motion detector activated by the user swinging his or her racket in front of the emitting end 225' of the device. Such a detector could be of any suitable type such as a photo sensor, a capacitance activated detector or a remote control activation device. The ball delivery device 200 also may employ a vibrator 219 to assist in maintaining a continuous passage of tennis balls through the funnel 214 and attached discharge chute 216.

Various other changes and modifications may be made in carrying out the present invention without departing from the spirit and scope thereof.

What is claimed is:

1. A tennis ball delivery device adapted to be activated by a player while practicing one's tennis stroke, said device comprising an adjustable frame, at least one declining ball delivery conduit carried by said frame in an upper portion thereof, a declining ball discharge chute carried by and communicating with said delivery conduit and a ball release mechanism operatively associated with said discharge chute so as to allow a single ball to fall from said chute in response to activation thereof, said mechanism including means responsive to engagement for activating said ball release mechanism, said means being positioned so as to be engaged by the player's racket while practicing a tennis stroke.

2. The tennis ball delivery device of claim 1 wherein said frame comprises an upper section, an intermediate section and a lower section, said sections being detachable and including means for varying the vertical mounting of said upper section on said intermediate section whereby the elevation of said ball discharge chutes can be varied.

3. The tennis ball delivery device of claim 2 wherein said frame sections are sized and configured such that upon detachment, each section fits within or about another section so as to define a nested configuration for the carrying of said tennis ball delivery device.

4. The tennis ball delivery device of claim 3 including a handle member carried by one of said frame sections and defining a releasable attachment member thereon for securing said handle member across said one frame section for carrying said tennis ball delivery device in said nested configuration.

5. The tennis ball delivery device of claim 1 wherein said frame comprises a plurality of detachable frame sections, one of said sections being configured such that upon detachment, said one section defines an open ended container for collecting and carrying a supply of tennis balls.

6. The tennis ball delivery device of claim 5 wherein said one frame section defines an end wall having a plurality of openings therein, said openings being sized such that upon said end wall being pressed downwardly against one or more tennis balls, said tennis balls compressed and passed through said end wall and into an interior portion of said frame section and carried thereby.

7. A tennis ball delivery device for use in practicing one's tennis stroke, said device comprising an adjustable frame, a first declining ball delivery conduit carried by said frame in an upper portion thereof, a first declining ball discharge chute carried by and communicating with said first delivery conduit and a ball release mechanism carried by said discharge chute, said mechanism allowing a single ball to fall from said chute in response to activation thereof, means for activating said ball release mechanism, a second declining ball delivery conduit, a second ball discharge chute carried by and communicating with said second delivery conduit, said first and second conduits being disposed in an adjacent helical juxtaposition and said first and second discharge chutes extending first and second conduits in opposed directions.

8. The tennis ball delivery device of claim 7 wherein said discharge chutes are removeably attached to said delivery conduits.

9. The tennis ball delivery device of claim 7 including a second ball release mechanism carried by said second discharge chute and wherein said first and second ball release mechanisms each comprises a stop member pivotally mounted on one of said discharge chutes so as to be moveable between a first position at least partially blocking said chute and a second position exteriorly of said chute and a second means for activating said second ball release mechanism wherein each said activating means comprises an elongated handle operatively connected to one of said stop members and adapted to be struck by the player for effecting rotational movement thereof and of said one stop member so as to move said one stop member from said first position to said second position and allow a ball to fall from one of said chutes.

10. The tennis ball delivery device of claim 9 including a spring member carried by each of said ball release mechanisms, said spring members being operatively connected to said stop members thereon for returning said stop members to said first position upon said stop member being moved to said second position.

11. The tennis ball delivery device of claim 9 including a second stop member pivotally mounted on each of said chutes about 2.25 inches from the first stop member, said second stop members pivoting with said first said first stop members and being disposed at an angular orientation of about 90° with respect thereto whereby upon one of said first stop members on one of said chutes pivoting from said first position in said second position, said second stop member on said one chute moves into from position exteriorly of said chute into the interior of said chute to prevent additional balls from falling from said chute.

12. The tennis ball delivery device of claim 7 including a second ball release mechanism carried by said second discharge chute and wherein said first and second ball release mechanisms each comprises a stop member pivotally mounted on one of said discharge chutes so as to be moveable between a first position at least partially blocking said chute and a second position exteriorly of said chute and a second means for activating said second ball release mechanism wherein said first and second activating means each comprises a motion detector operatively connected to one of said stop members for moving said one stop member from said first position to said second position so as to allow a ball to fall from one of said chutes in response to detecting movement proximate said detector.

13. The tennis ball delivery device of claim 7 wherein said frame comprises an upper section, an intermediate section and a lower section, said sections being detachable and at least said upper and intermediate sections being at least partially formed of welded wire and including means for varying in the vertical mounting of said upper section on said intermediate section whereby the elevation of said ball discharge chutes can be varied.

* * * * *